US006133888A

United States Patent [19]

Mohuchy

[11] Patent Number: 6,133,888

[45] Date of Patent: Oct. 17, 2000

[54] POLARIZATION-AGILE MULTI-OCTAVE LINEAR ARRAY WITH HEMISPHERICAL FIELD-OF-VIEW

[75] Inventor: Wolodymyr Mohuchy, Nutley, N.J.

[73] Assignee: ITT Manuafacturing Enterprises, Inc., Wilmington, Del.

[21] Appl. No.: 09/198,110

[22] Filed: Nov. 23, 1998

[51] Int. Cl.[7] ..... H01Q 11/10

[52] U.S. Cl. ..... 343/770; 343/740

[58] Field of Search ..... 343/770, 811, 343/2, 3, 4, 753, 5, 795, 824, 873; 455/327, 314

[56] References Cited

U.S. PATENT DOCUMENTS

| | | | |
|---|---|---|---|
| 3,596,272 | 7/1971 | Blonder | 343/792.5 |
| 5,396,658 | 3/1995 | Hwu et al. | 455/327 |
| 5,528,254 | 6/1996 | Howng et al. | 343/873 |

*Primary Examiner*—Don Wong
*Assistant Examiner*—James Clinger
*Attorney, Agent, or Firm*—Saul Elbaum

[57] ABSTRACT

An antenna including a plurality of radiating elements disposed in mutually orthogonal pairs arranged in a predetermined pattern to radiate and receive RF signals over multi-octave frequency bands; and divergent lens means to provide stability for the predetermined pattern of radiating elements.

24 Claims, 4 Drawing Sheets

POLARIZATION-AGILE MULTI-OCTAVE LINEAR ARRAY WITH HEMISPHERICAL FIELD-OF-VIEW

FIELD OF INVENTION

The present invention relates to an antenna and more particularly to a microwave-phased array antenna that can operate over multi-octave bandwidths and provide polarization-agile radiated signals over a hemispherical field-of-view.

DESCRIPTION OF PRIOR ART

Modern phased array systems are required to operate over very wide frequency bandwidths with a single radiating aperture. In such broad band environments, the processing functions previously performed by individual antennas must now be performed by a single phased array.

The critical parameter of many Rf signals is polarization, requiring the array to respond to any linear, circular or elliptical polarization which in the art is designated as polarization diversity or agility. Antenna polarization agility is most readily achieved with an orthogonally disposed pair of radiating elements that are electronically processed via a vector controller such as has been described by Mohuchy in co-pending U.S. patent application Ser. No. 08/838,054 entitled "Gallium Arsenide Based Vector Controller for Microwave Circuits", the disclosure of which is hereby incorporated by reference.

As is known, a principal guideline in designing an efficient phased array is to preclude the formation of secondary radiating lobes that severely affect the net radiated gain of the array. In the parlance of the art, radiation of grating lobes must be excluded from the real space when the array is steered (scanned) over its designated field-of-view. This condition is achieved when:

$$\lambda/s \text{ is } \leqq 1+\sin(\theta) \quad (1)$$

where "λ" is the free-space wavelength, at the highest operating frequency, "s" is the element spacing in the direction of array scan, and "θ" is the maximum scan angle of the phased array.

As the array needs to be scanned to ±90° in order to cover the hemispherical field-of-view, the acquired element spacing at the highest operating frequency becomes:

$$\lambda/2 \quad (2)$$

In a classical phased array arrangement, such as has been described by Monser in U.S. Pat. No. 3,836,976, the physical size of the element becomes too small to radiate efficiently beyond an octave bandwidth. That is, with λ/2 element spacing at the high end, the radiating element shall be much less than λ/4 in electrical length at the low end of the band.

One object of the present invention is to eliminate the physical limitation on the size of the radiating element. A second object of the present invention is to eliminate the blind spots in the radiated field-of-view by stabilizing the element pattern of the operating bandwidth. It is a further object of the present invention to provide an efficient, multi-octave phased array with hemispherical field-of-view. It is yet a further object of the present invention to provide an improved phased array antenna adapted to operate in any desired polarization. Finally, it is yet another object of the present invention to provide an improved phased array free of blind spots in its field-of-view.

SUMMARY OF THE INVENTION

An antenna including a plurality of radiating elements disposed in mutually orthogonal pairs arranged in a predetermined pattern to radiate and receive RF signals over multi-octave frequency bands; and divergent lens means to provide stability for the predetermined pattern of radiating elements.

DETAILED DESCRIPTION OF THE PREFERRED EMBODIMENT

These and other objects of the invention are generally attained by providing pairs of mutually orthogonal radiating elements arranged in a linear herringbone pattern. Element pattern stability is achieved using unique divergent lenses, which are also arranged in herringbone pattern and optimized to eliminate array "blind spots". In other words, by placing the radiating elements in a manner that allows one degree of dimensional freedom, such objects can be attained. In the present case, it is preferably the length of the element that can be varied to provide the most efficient radiating properties for each element of choice.

The net radiation patterns of a phased array is the product of the array factor and the element pattern. In a simplest interpretation, the array factor is the principal contributor to the gain of the array. The larger the array, the greater the gain. The element pattern tailors the scanned array pattern and causes it to fit its profile as a function of the scan angle. Thus, the array field-of-view is directly dependent on the spacial behavior of the element pattern and, for example, should the element pattern go to zero within a given sector, the array would not be capable of receiving or transmitting in that sector. This is commonly referred to as a "blind spot". The pertinence of this physical reality to the present invention is the following:

In order to produce a most efficient radiating element, its dimensions need to be a significant portion of a wavelength (≧λ/2 for example). In a two octave design, if the optimum element size is selected at the low end of the operating band, then, at the high end of the band the element would be much greater than a wavelength and the resultant element pattern would produce multiple nulls or "blind spots" in the array pattern coverage.

Figure 1:
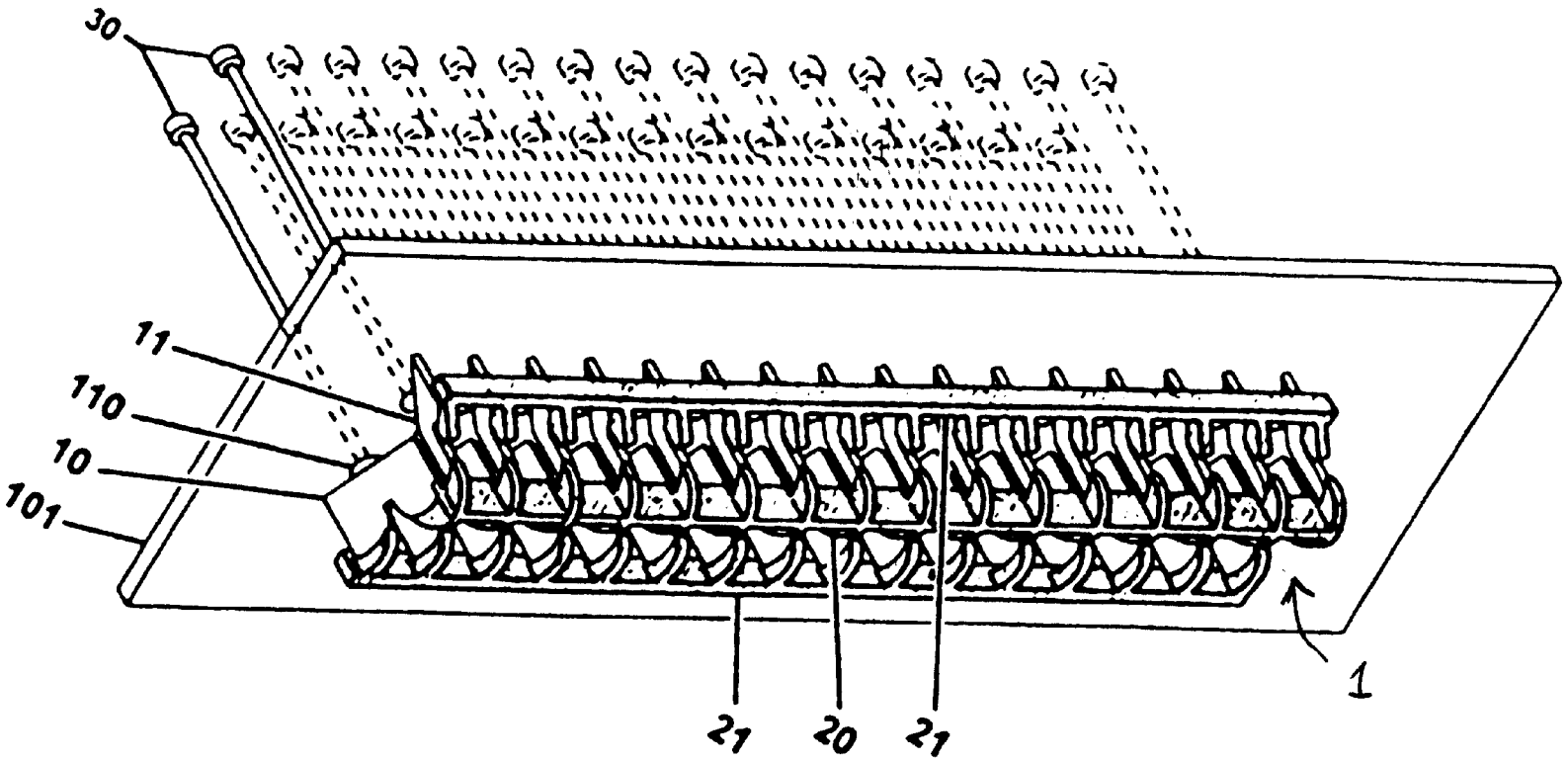
FIG. 1 illustrates a top view of a radiating element layout in the linear, herringbone array.

Referring more particularly now to the several figures, wherein like references refer to like elements of the invention, the phased array of the invention is illustrated in FIG. 1, which depicts a linear array 1 including an arbitrary number of orthogonally disposed pairs of radiating elements 10 and 11, which are substantially identical in design. Their relative placement is detailed in FIGS. 2, 3 and 5, where each element 10, 11 is aligned to the array scan axis at 45°. The actual number of element (10, 11) pairs (N) is determined by system gain requirements as calculated using known physical relationships. A large variety of radiating elements 10, 11 can be employed in the design, however, the preferred element configurations for very broad band applications are based on notches either in strip line, such as in Mohuchy (U.S. Pat. No. 4,978,965) or derivative of the Vivaldi notch, as will be used to demonstrate in the concept of this invention as follows.

Access from each element 10, 11 to the array feed/control network is provided via coaxial transducers 110, placed within the mounting structure 101 which is usually a ground plane but on occasion may be an absorbent to dampen unwanted radiating loads.

The critical parameters in the design are the element 10, 11 spacing s and element 10, 11 length L. The element 10, 11 spacing s is derived at the highest operating frequency using equation 2, while L, the element 10, 11 length, is determined by the Rf cut-off characteristics at the low end of the band.

Figure 5:
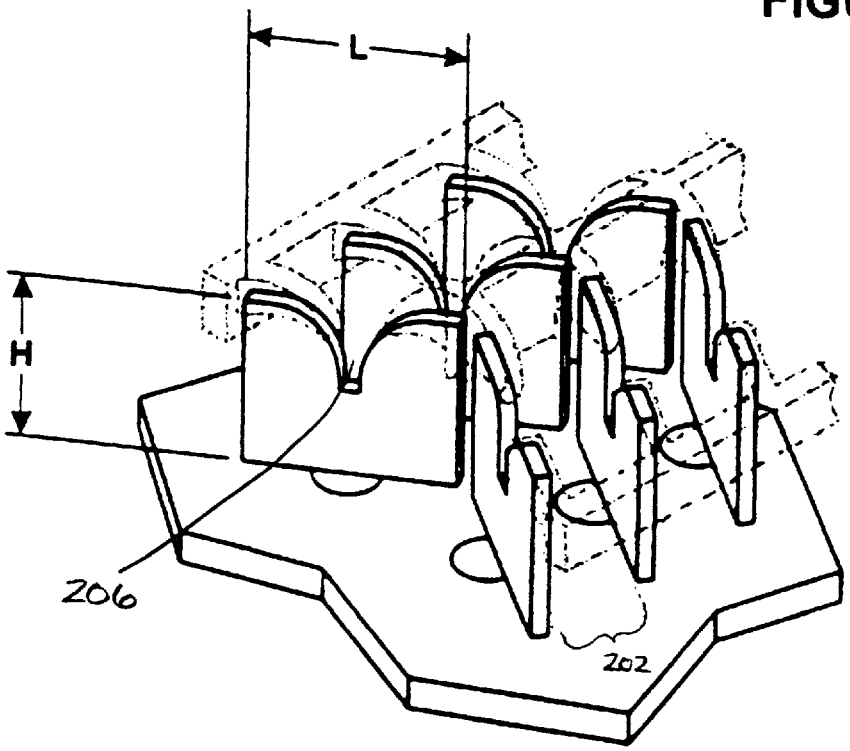
FIG. 5 illustrates the highly tailored, divergent lenses employed to eliminate "blind spots" in the irradiated field-of-view.

Referring now also to FIG. 5, it is evident therefrom that the element 10, 11 disposition in the herringbone array allows for any desired length when compared to the "egg crate" structures of Monser for example.

A basic law of radiating structures is the inverse relationship of a pattern bean width to the size of the radiating aperture 1. For example, a line source one wavelength long will produce a null at 57.3°. In an array environment, this would produce a "blind spot" at that angle in space. If, for example, an array were designed to operate over two octaves, and the element length were $\lambda/4$ at the lowest frequency to assure good radiating efficiency, then at the high end of the band where the electrical length would be a full wavelength, "blind spots" would occur as a function of frequency and scan angle. A lensing device has been devised to eliminate this problem. The sensing device is made of dielectric material and is shaped to provide phase distortion (defocusing) across the radiating aperture. This shape is computed using physical optics as defined by Snell's law, however, in a very broad band application, the computed dimensions need to be adjusted experimentally to optimize the performance over the entire operating band. The exact shape and placement of the lensing devices are detailed by the following with the aid of FIGS. 2, 4 and 5.

Figure 4:
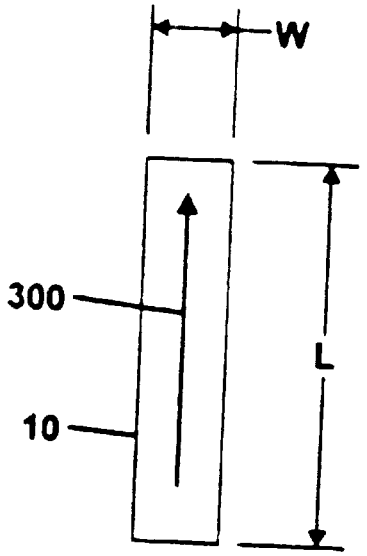
FIG. 4 illustrates the electrical field orientation with respect to the top view of each radiating element according to the present insertion.

Referring more particularly now to FIG. 4, the top view of a radiating element 10, 11 that is suitable for use in a herringbone configuration is illustrated. Its width is designated W and length L. Also illustrated therein is the orientation of he field vector 300. The orientation parallel to the field vector is herein designated the E-plane and the orientation perpendicular to the vector is the H-plane.

For notch radiators the dimension W is usually less than $0.1\lambda$ and consequently sill produce a very broad pattern in the H-plane. The dimension L is always a significant part of the wavelength and must be treated to eliminate spacial nulls. The problem arises when the E-plane pattern-correcting lens impinges on the H-plane. The result is the narrowing of the H-plane element pattern, which is undesirable.

Figure 2:
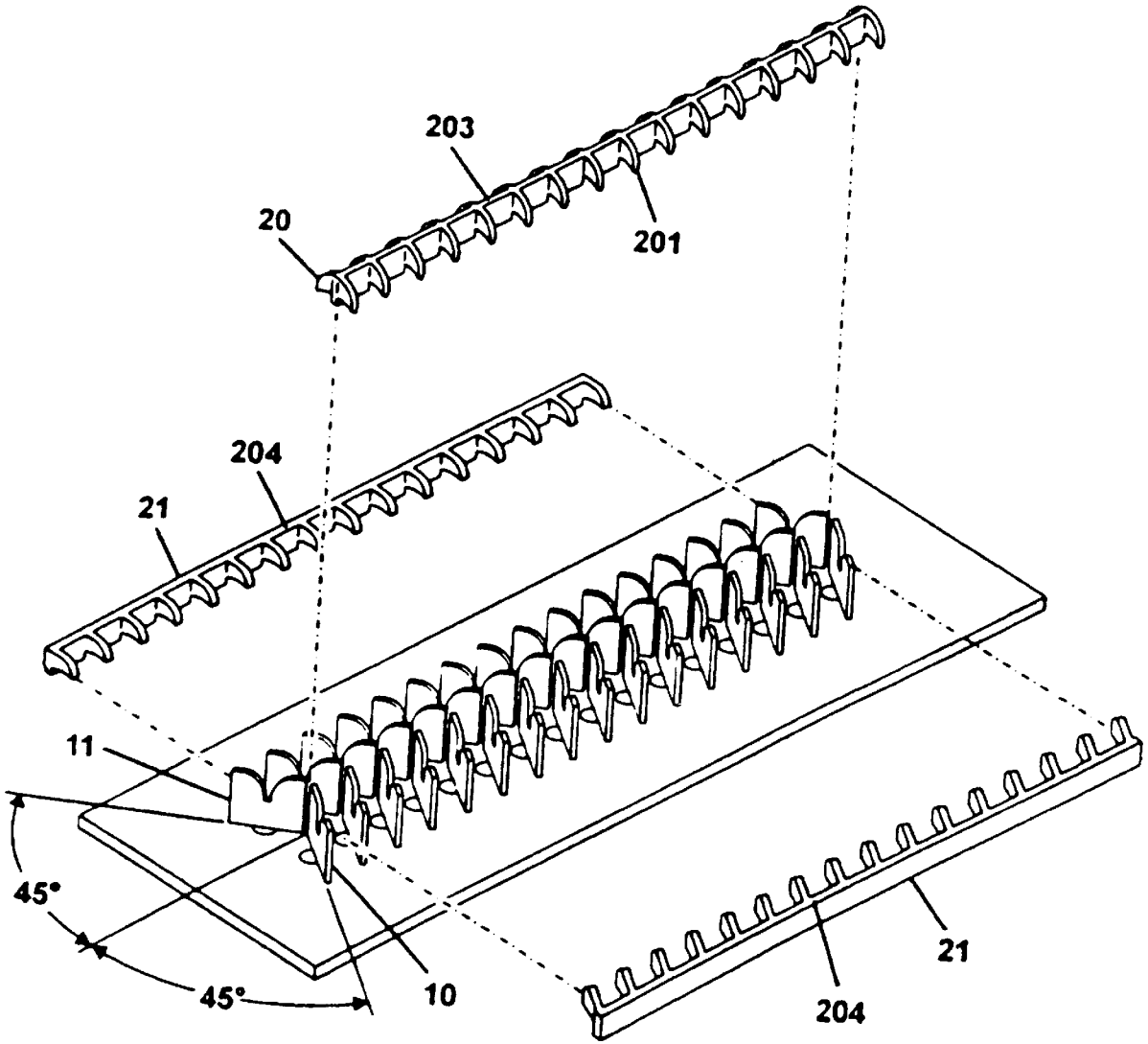
FIG. 2 illustrates an exploded perspective view of a phased array antenna according to the invention and the access paths to the array feed network.
Figure 3:
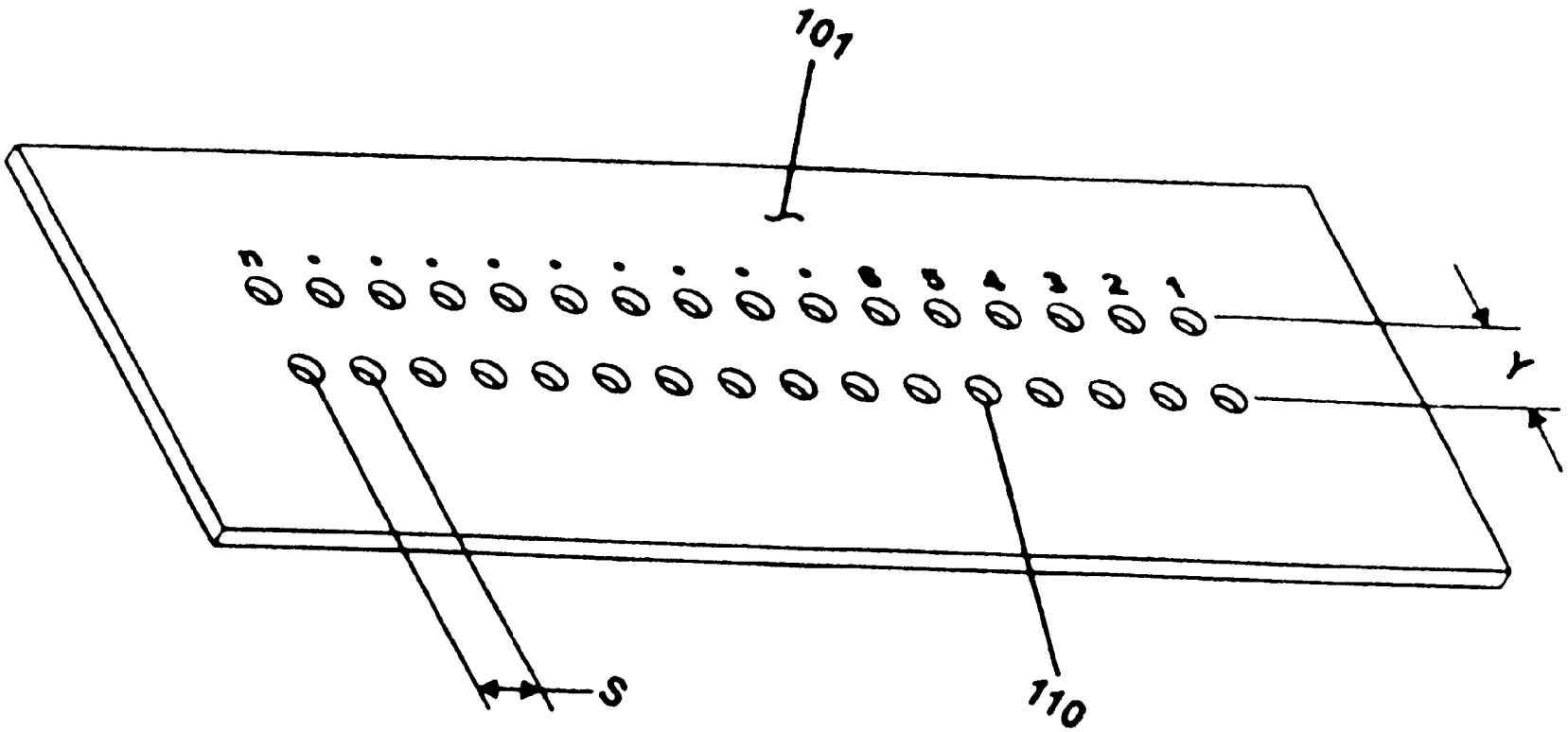
FIG. 3 illustrates the layout of the ground plane housing of the herringbone array.

Referring now particularly to FIGS. 2 and 5, two lens types 20 and 21 are employed therein. The basic cross-sectional shapes are hem-spherical and are profiled for good mechanical fit with he array elements 10, 11. Lens 20 is positioned over The inner portions of the orthogonal element set. At the center of lens 20 is a supporting rib 203 that connects across the entire array 1. The lens 20 also preferably has a herringbone shape with spokes 201 thereof covering the respective radiating elements 10, 11. Preferably each spoke 201 protrudes approximately one-quarter of the distance into the element aperture 206 but in practice may be adjusted experimentally to optimize the performance over the full operating band.

The gaps 202 between the lens elements 10, 11 are included to minimize the lensing effects in the element H-plane. Lenses 21 are preferably placed at the edges of the elements and are similarly constructed to the center lens 20, preferably the lens elements 20, 21 are bonded directly to the radiating elements 10, 11.

A five element proof-of-concept array was fabricated and measured over a 4–20 GHz frequency band using classical solid-metal Vivaldi radiator pairs. The unit was evaluated both with and without the lens treatment. The "blind spot" effects were clearly evident in the first configuration, however, were eliminated in the lensed array. The operating parameters used were:

dimension s=0.36 inches
dimension L=0.80 inches
dimension W=0.15 inches
dimension H=1.50 inches
dimension d=0.40 inches
dimension p=0.16 inches Where d is the diameter of the lens curvature (201 and 204) and p is the width of the joining rib (203 and 205). The lenses were fabricated from Rexolite, a dielectric material having a dielectric constant of 2.1.

Having described a preferred embodiment of this invention, it is evident that other embodiments incorporating these concepts may be used. For example, the entire family of notch radiators, dipole radiators and radiators in general whose effective width is less than the element spacing required to suppress grating lobes can be used.

In the area of suppressing lenses 20, 21 a host of dielectric materials can be used. Their shape, size and exact orientation with respect to the radiating elements would have to be determined by the actual array performance goals.

Accordingly, although the invention has been described and pictured in a preferred form with a certain degree of particularity, it understood that the present disclosure of the preferred form has been made only by way of example and that numerous changes in the details of construction and combination and arrangement of parts may be made without departing from the spirit and the scope of the invention as here and after claimed. It is intended that the patent shall cover by suitable expression in the appended claims whatever features of patentable novelty exists in the invention disclosed.

I claim:

1. A phased array antenna comprising:

a phased array of radiating elements arranged in a predetermined pattern to radiate and receive RF signals in an antenna beam pattern that is steerable over a field of view; and a divergent lens device configured and positioned with respect to said phased array to cause phase distortion and defocusing of the antenna beam pattern to thereby eliminate blind spots in the field of view.

2. The antenna of claim 1, wherein said predetermined pattern is adapted to facilitate said phase array of radiating elements to transmit and receive linearly, circularly, and elliptically polarized RF signals over multi-octave frequency bands.

3. The antenna of claim 1, wherein said antenna has a hemispherical field-of-view.

4. The antenna of claim 1, wherein the length of each of said radiating elements is not restricted by a grating lobe.

5. The antenna of claim 1, wherein a radiation efficiency of each of said radiating elements is greater than if a length associated with each of said radiating elements were restricted by a grating lobe.

6. The antenna of claim 1, wherein said predetermined pattern is a linear herringbone pattern.

7. The antenna of claim 1 wherein each of said radiating elements is positioned 45° relative to an array scan axis.

8. The antenna of claim 1, wherein the number of said radiating elements is associated with system gain requirements.

9. The antenna of claim 1, further comprising a plurality of coaxial transducers each being associated and coupled to a respective one of said radiating elements.

10. The antenna of claim 9, further comprising a ground plane including a plurality of apertures, wherein each of said plurality of apertures is associated with a respective one of said coaxial transducers which passes through it.

11. The antenna of claim 10, wherein said plurality of apertures in configured in a plurality of rows, and a distance between consecutive apertures in a row selected from said plurality of rows is dependent upon the highest desired operating frequency of said antenna.

12. The antenna of claim 1 wherein each of said radiating elements has a length dependent upon desired RF cut-off characteristics at the low end of a frequency band of said antenna.

13. The antenna of claim 1, wherein said divergent lens device comprises a dielectric material.

14. The antenna of claim 13, wherein said dielectric material has a dielectric constant of approximately 2.1.

15. The antenna of claim 1, wherein said divergent lens device comprises:

a first lens bonded to at least one of said radiating elements and comprising a center rib which connects across the entire antenna, and a plurality of center spokes transversely disposed and integrally coupled to said center rib; and, a second lens bonded to at least one of said radiating elements and comprising at least one side rib including a plurality of side spokes transversely disposed and integrally coupled to said at least one side rib.

16. The antenna of claim 15, wherein each of said plurality of center spokes is associated and positioned adjacent a pair of said radiating elements.

17. The antenna of claim 16, wherein each of said plurality of side spokes is associated with and positioned adjacent one of said radiating elements.

18. The antenna of claim 1, wherein said antenna radiates and receives over a multi-octave frequency band and the radiating elements arc arranged in mutually orthogonal pairs.

19. A method of eliminating blind spots in the field of view of a phased array antenna configured to radiate and receive RF signals in an antenna beam pattern that is steerable over the field of view, the method comprising the step of:

defocusing the antenna beam pattern with divergent lenses, thereby eliminating grating lobe nulls that would otherwise occur in the antenna beam pattern at certain scan angles.

20. A phased array antenna, comprising:

a plurality of phased-array radiating elements configured to radiate and receive RF signals in an antenna beam pattern that is steerable over a field of view, said radiating elements being arranged in a herringbone pattern about an array scan axis.

21. The phased array antenna of claim 20, wherein all of said radiating elements are positioned at a same angle relative to the array scan axis.

22. The phased array antenna of claim 21, wherein the same angle is 45 degrees, such that the radiating elements are arranged in mutually orthogonal pairs.

23. The phased array antenna of claim 20, wherein all of said radiating elements have a same length.

24. The phased array antenna of claim 20, further comprising:

a divergent lens device configured and positioned with respect to said radiating elements to cause phase distortion and defocusing of the antenna beam pattern to thereby eliminate blind spots in the field of view.

* * * * *